US007108585B1

(12) United States Patent
Dorfman et al.

(10) Patent No.: US 7,108,585 B1
(45) Date of Patent: Sep. 19, 2006

(54) MULTI-STAGE ABRASIVE-LIQUID JET CUTTING HEAD

(76) Inventors: Benjamin F. Dorfman, 229 19th Ave., Apt. #9, San Francisco, CA (US) 94121; Steven A. Rohring, 28 St. James Pl., Buffalo, NY (US) 14222

( * ) Notice: Subject to any disclaimer, the term of this patent is extended or adjusted under 35 U.S.C. 154(b) by 0 days.

(21) Appl. No.: 11/278,760

(22) Filed: Apr. 5, 2006

Related U.S. Application Data

(60) Provisional application No. 60/668,453, filed on Apr. 5, 2005.

(51) Int. Cl.
*B24C 5/04* (2006.01)

(52) U.S. Cl. ..... 451/38; 451/102; 451/90; 83/53; 83/177; 239/310

(58) Field of Classification Search ..... 451/90, 451/99, 102, 40, 101; 83/53, 177; 239/310, 239/318, 433, 434
See application file for complete search history.

(56) References Cited

U.S. PATENT DOCUMENTS 2,040,715 A * 5/1936 Smith ..... 451/40
5,637,030 A 6/1997 Chopra et al.
5,785,582 A * 7/1998 Stefanik et al. ..... 451/102
5,851,139 A * 12/1998 Xu ..... 451/102
5,876,267 A * 3/1999 Kanda ..... 451/38
6,283,833 B1 * 9/2001 Pao et al. ..... 451/40
6,386,949 B1 * 5/2002 Hagiwara et al. ..... 451/40
6,425,805 B1 * 7/2002 Massa et al. ..... 451/40
6,634,928 B1 10/2003 Erickson et al.
6,755,725 B1 * 6/2004 Hashish et al. ..... 451/101
6,814,649 B1 * 11/2004 Schmall ..... 451/2
6,851,627 B1 2/2005 Hashish et al.

* cited by examiner

*Primary Examiner*—Lee D. Wilson
*Assistant Examiner*—Anthony Ojini
(74) *Attorney, Agent, or Firm*—Vincent G. LoTempio; Kloss Stenger Krole and LoTempio

(57) ABSTRACT

A multistage abrasive-liquid jet cutting head comprising at least a first and a second mixing stage. Within the first mixing stage is a first mixing chamber arranged to accept a first flow of accelerated abrasive particles from a first abrasive feed tube and a pressurized liquid flow from an orifice and produce a pressurized slurry-like flow that is introduced to the second mixing stage. Within the second mixing stage is a second mixing chamber arranged to accept and mix is second flow of accelerated abrasive particles from a second abrasive feed tube with the pressurized slurry-like flow from the first mixing stage. An exit nozzle in fluid communication with the second mixing chamber that focuses the combination of the second flow of accelerated abrasive particles from the second abrasive feed tube with the pressurized slurry-like flow from the first mixing stage into an abrasive jet.

17 Claims, 3 Drawing Sheets

MULTI-STAGE ABRASIVE-LIQUID JET CUTTING HEAD

This application claims priority of U.S. Provisional patent application to Benjamin F. Dorfman and Steven A. Rohring, Ser. No. 60/668,453 for METHODS FOR IMPROVING ABRASIVE JET TECHNOLOGY AND APPARATUS FOR THE SAME, filed on Apr. 5, 2005.

FIELD OF INVENTION

The invention relates to the field of high-pressure abrasive-liquid jet (also sometimes known as 'Abrasive Waterjet' or 'Abrasivejet') technology often used in material removal, and more specifically, improvements upon conventional abrasive-liquid jet technology in the area of multi-stage abrasive particle jet formation.

BACKGROUND OF THE INVENTION

Conventional abrasivejet technology is used to cut a variety of materials but is found to be highly inefficient in the use of energy and resources mainly due to equipment design limitations that incorporate use of garnet as the abrasive. Conventional abrasivejet is also currently limited to perform one purpose at a time such as thru cutting of material or surface removal of material as there are not any abrasivejet systems currently producing useful byproducts simultaneously with the initial purpose of material removal. This is primarily due to the widespread acceptance of garnet as the preferred abrasive for almost all conventional applications.

A high-pressure pump is utilized to generate fluid pressure, usually above 30,000 psi, and preferably with water or water with additives as the liquid medium. The pressurized liquid is then transported at high velocities through tubing to a cutting head that mainly consists of an orifice to deliver the liquid, an abrasive feed tube, a mixing chamber where the liquid and abrasive are mixed, and a nozzle (sometimes called a focusing tube or a mixing tube) that finally directs the abrasivejet stream onto the subject material that is to be removed.

Currently, there are not any significant differences between any cutting heads or techniques of conventional abrasivejet equipment manufacturers, as generally all orifice, nozzle, and abrasive materials incorporated are the same for each manufacturer. Orifices are usually made from hard materials such as diamond or sapphire that generally produce a non-laminar jet. Nozzles are mostly made from a very hard tungsten carbide. Conventional abrasivejet equipment manufacturers also have similar cutting head designs with non-significant variations between each design. These cutting head designs have been widely demonstrated to cut at speeds within 30% of each other with similar surface finishes in comparative testing when equal parameters were used.

A more important similarity, as well as deficiency, of conventional abrasivejet technology is the widespread use of garnet abrasives over all other abrasives. Garnet is widely used because of its initial low cost and ability to cut a wide range of subject materials, however, it is widely used mainly because of its lower overall costs when compared to other conventional abrasives.

Conventional abrasivejet technology does not effectively use abrasives other than garnet due to numerous factors such as higher initial costs of most other hard abrasives compared to garnet and the inability of other hard abrasives to cut significantly faster than garnet. These factors generally result in higher overall costs of abrasive consumption after considering the final amount of material cut. There is also the limitation of conventional abrasivejet cutting head technology preventing use of harder abrasives than garnet because of the increased costs of accelerated nozzle wear created by these harder abrasives.

The similarities of conventional cutting head designs' primary use of only one type of nozzle material, use of only one abrasive medium, and use of only two types of orifice materials, mainly produce a common limitation of an approximate 3:1 nozzle to orifice ratio. This means the bore of the nozzle is generally three times larger than the diameter of the orifice. The volume of the abrasivejet stream inside the bore of the nozzle consists of an air, high-pressure liquid and abrasive mixture, with a relatively low amount of high-pressure liquid. The liquid is where the process energy originates in the cutting head. Therefore, a relatively larger volume of area of area in the nozzle bore compared to the smaller area of volume of the liquid energy creates inefficiencies.

A solution to create a more efficient use of energy would incorporate a smaller nozzle to orifice ratio such as 2:1 but this solution is not currently viable with use of conventional cutting heads and garnet abrasives. The best solution for conventional technology has been use of relatively small volumes of high-pressure liquid in the abrasivejet mixture allowing for variable cutting, but this also reduces the effective cutting energy by being dispersed over a greater area, hence, the effective energy is not optimally focused.

U.S. Pat. Nos. 3,424,386, 3,972,150, 4,080,762 and 4,125,969 all teach the abrasive (sand) stream to be in the central portion of the nozzle while the pressurized fluid is introduced into the peripheral area surrounding the central sand stream. A ring orifice plate or disk such as employed in the U.S. Pat. Nos. 3,424,386, 4,080,762 and 4,125,969 to provide the fluid jets around the sand stream has many disadvantages including: the introduction of pressurized fluid tangentially into a nozzle a short distance above the orifice disk is not conducive to the generator of a coherent fluid jet due to flow disturbances upstream of the orifices; sand in the central portion of a nozzle creates an abrasive environment that can weaken the interior wall of the annular fluid chamber without being detected; pressurized fluid in the outer annular space results in a nozzle that is very large in dimensions as both interior and exterior walls must be sized to accommodate the fluid pressure; and sealing the annular orifice disk can be very troublesome. The U.S. Pat. No. 3,994,097 teaches a central located water jet while sand is fed into a nozzle chamber through a single sand passageway. The sand is forced into the water jet by passage through a conical nozzle. This patent recognizes abrasion problems within the nozzle and the necessity of exact alignment. These problems would be intensified at higher pressures. All of these patients teach mixing abrasive into water by (1) intercepting an abrasive stream with water jets, and (2) forcing abrasives, water and air through a conical nozzle, without concern of fluid actions.

FIG. 1 of U.S. Pat. No. 5,184,434 depicts how the majority of abrasivejet cutting heads are currently designed. The problem areas with the prior art cutting head shown in this patent are the orifice, the mixing chamber and the liquid jet. The orifice is the device where the liquid jet passes through, building up to very high velocities. The mixing chamber is the area where abrasive joins with the liquid jet. A problem with this design is the separation effect of the jet as it starts to break up. The nozzle inlet then receives the stream at various angles and straightens it out while realizing considerable wear on its bore. FIG. 2 of U.S. Pat. No. 5,184,434 depicts the art of Abrasive Suspension Jet (sometimes called "Slurry Jet") cutting. This methods adds abrasive to the stream before entering the orifice. The advantage of this method is that it produces a coherent jet, but the disadvantage is that components such as tubing, valves and orifices wear out quickly due to the abrasive suspension inside the system severely eroding everything it contacts.

Another disadvantage of the orifice designs in conventional abrasivejet is the sharp transition from the pump tubing to the relatively small orifice. This sharp transition creates a high resistance of the pressure flow and does not allow for property formed liquid optimization, resulting with jet distortion, and decrease in overall energy efficiency of the system.

Garnet is conventionally used because it does not wear the nozzles out significantly even with the non-laminar jet produced a conventional orifice as shown in FIG. 1 of U.S. Pat. No. 5,184,434, Garnet also has a low initial cost and it is effective in cutting a wide range of materials without significantly wearing the nozzles while using the standard 3:1 nozzle to orifice size ratio. These factors allow for a lower overall cost compared to other abrasives and have allowed garnet to be the primary abrasive medium used for almost all abrasivejet applications. However, there are many reasons why garnet is not the optimum abrasive available when considering the complete abrasivejet system, recycling and the ability to perform two or more processes in one operation.

One reason is that garnet is not the optimum abrasive is because it is not recyclable effectively. It is widely accepted that only 30% to 50% of larger garnet particles can be reclaimed for reuse after single cutting operation as most of the garnet particles are reduced in size from fracturing upon impact and made less effective for further cutting of subject materials. Current recycling processes of garnet generally add unused larger particles to the reclaimed particles in order to keep cutting speeds at an acceptable level.

Another disadvantage is that very hard subject materials such as carbides and hard ceramics are generally not cut with abrasivejet technology because of the very low cutting speed ability of garnet to cut these materials.

Thus it is readily apparent that there is a longfelt need for a multistage water jet cutting head that can cut subject materials more effectively by a high-pressure water jet mixed with abrasive particles in a multi-stage approach.

SUMMARY OF THE INVENTION

The present invention is a multi-stage approach for the formation of an abrasive-liquid mixture through a multistage abrasive-liquid jet cutting head comprising at least a first and a second mixing stage. Within the first mixing stage is a first mixing chamber arranged to accept a first flow of accelerated abrasive particles from a first abrasive feed tube and a pressurized liquid flow from an orifice and produce a pressurized slurry-like flow that is introduced to the second mixing stage. Within the second mixing stage is a second mixing chamber arranged to accept and mix a second flow of accelerated abrasive particles from a second abrasive feed tube with the pressurized slurry-like flow from the first mixing stage. An exit nozzle in fluid communication with the second mixing chamber that focuses the combination of the second flow of accelerated abrasive particles from the second abrasive feed tube with the pressurized slurry-like flow from the first mixing stage into an abrasive jet.

Two or more feeding tubes are used to introduce abrasive into the waterjet stream in order to create more impact energy for faster cutting rates of subject materials. Improvements and novel techniques for high-pressure abrasive-liquid jet technology are disclosed herein describing more efficient use of energy and resources compared to current abrasive jet technology to allow for faster abrasive jet cutting rates of subject materials. These benefits are realized through the following improvements: use of two or more specially engineered abrasive particles with specific properties and use of these mixed particles in the abrasive jet stream; optimization of individual components of the cutting head and optimization of their relationships to each other as a complete system.

It is a general object of the present invention to provide a multistage water jet cutting head using non-conventional abrasives and optimized cutting head configurations both designed for improvements to traditional abrasive jet applications along with creating new areas of technology currently not associated with abrasive jet.

Another object of the present invention is to provide a multistage water jet cutting head using subject materials that are processed more efficiently through optimization of the abrasive mixture process into a water jet stream, resulting with reduced overall costs of the abrasive jet technique for cutting or other material removing technology.

Yet another object of the present invention is to provide a multistage water jet cutting head that provides improvements to the abrasive jet technique generating increased cutting speeds through achieving better tolerances, and higher resulting surface finish quality of subject materials.

Still another object of the present invention is to provide a multistage water jet cutting head that fosters the creation of several novel manufacturing technologies based on the abrasive jet technique as disclosed herein.

A further object of the present invention is to provide a multistage water jet cutting head where a multi-stage approach allows for a more gradual, and more effective, mixing of the abrasive particles with the waterjet to allow for faster particle acceleration and greater cutting speeds.

Yet another object of the present intention is to provide a multistage water jet cutting head comprised of a solid component.

Another object of the present invention is to provide a multistage water jet cutting head produced from modular components.

These and other objects, features, and advantages of the present invention will become apparent upon a reading of the detailed description and claims in view of the several drawing figures.

DETAILED DESCRIPTION OF THE INVENTION

Figure 1:
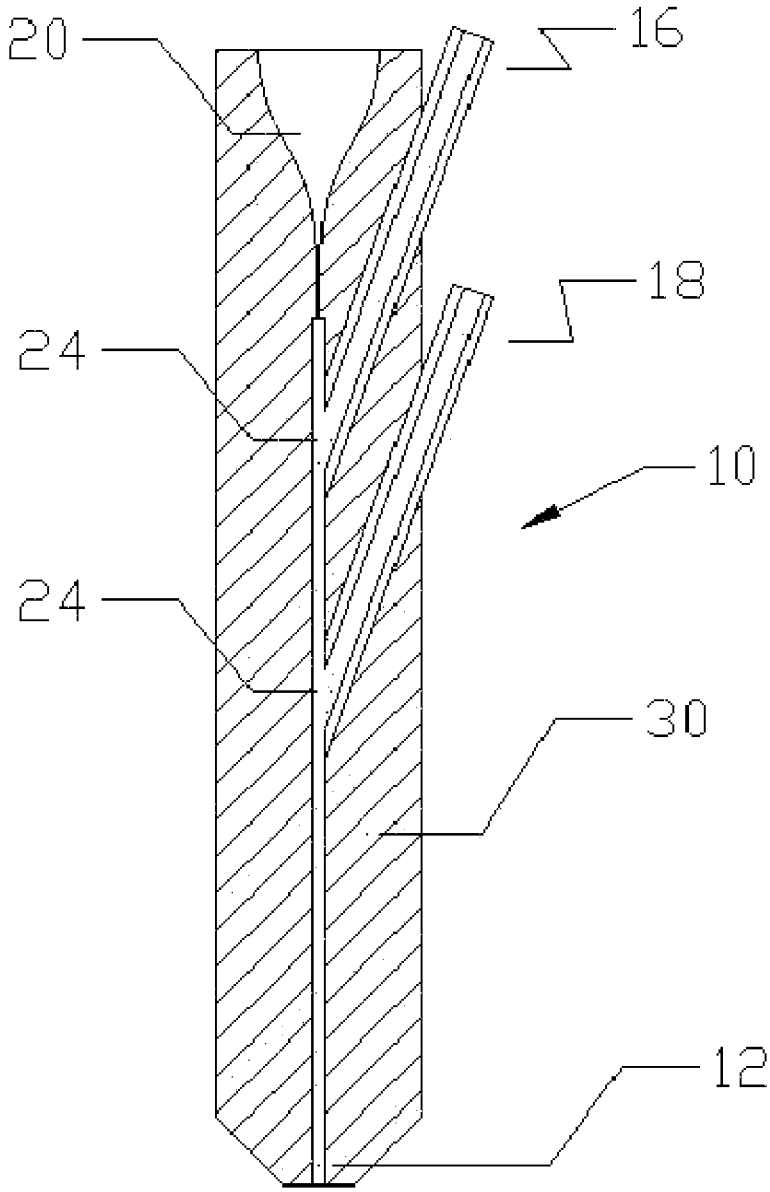
FIG. 1—A perspective view of a solid component multistage water jet cutting head.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

For purposes of this patent, the terms appearing below in the description and the claims are intended to have the following meanings:

"Abrasive" means any particulate material intentionally introduced into a pressurized liquid jet in the form of sharp edge particles, such as angular, cubical, or non-spherical shapes, generally used for material removal or surface treatment upon interaction with subject material.

"Abrasivejet" means a mixture of a high pressure liquid jet stream and abrasive particles focused through a nozzle to provide for a useful tool.

"Subject material" means any material intentionally exposed to the impact of a pressurized liquid jet carrying particles of abrasive material.

"Waterjet" means a pressurized liquid stream generated by a pump, distributed by high pressure tubing, and then focused through an orifice to create a useful tool for cutting or surface treatment.

"Nozzle" means a channel that mixes abrasive with a pressurized liquid jet and focuses the abrasivejet in a concentrated stream upon exit of the nozzle tip (a nozzle is also known as a focusing tube or mixing tube). The smallest opening of the channel is the specified size of the nozzle. The specified size of the nozzle is important in determining the nozzle to orifice ratio, as all of the abrasivejet is focused into the smallest area.

"Orifice" means an opening that accepts a pressurized liquid stream and allows it to pass thru. The opening is generally specified as a diameter. The selection of the orifice size generally determines the output pressure of the high pressure system based upon the capabilities of the pump and the operating speed of the pump.

"Cutting Head" means a device used in an abrasivejet system that contains an orifice aligned to a nozzle, whereas the orifice produces a jet that is directed into the central channel area of the nozzle. The cutting head allows for the establishment of the nozzle to orifice ratio after the nozzle and orifice are installed into the cutting head.

"Nozzle to Orifice Ratio" means the total area of the smallest opening of the channel in a nozzle compared to the total area of the smallest opening of the orifice. Generally, the openings for nozzles and orifices are cylindrical in shape. For example, a conventional abrasivejet cutting head of prior art would utilize a 0.030" diameter nozzle if a 0.010" diameter orifice were installed, thus realizing a 3:1 nozzle to orifice ratio.

"High-Pressure" means a liquid pressure exceeding 10,000 psi.

"Surface Treatment" means intentional change of any characteristics of materials subjected to the impart of pressurized liquid jet carrying particles of abrasive material. Treatment may be realized by partial removing of subject material and/or change of its surface morphology (such as polishing or etching), and/or superficial structure, such as size and shape of its superficial grains., generating dislocations and/or other structural defects, and/or superficial composition of subject material by the impact of pressurized abrasive-liquid jet. Treatment may be resulted with predesigned cutting or other change of geometrical shape of subject material or with an intentional change of its superficial mechanical properties (such as hardness), and/or tribological, and/or physicochemical, and/or electrochemical and corrosion resistance properties, and/or catalytic properties, and or external appearance, reflectively or color.

Improvements to abrasive particle selection through the implementation of pre-engineered abrasives with high recyclability and greater density are determined to be the optimum solution for most abrasivejet applications. Greater amounts of cutting energy are transmitted when a good mixture of these heavier particles are mixed properly with a waterjet. The kinetic energy of the impact against a subject material is improved when these particles are accelerated to the speed of the waterjet. This can only occur with a good suspension, or mixture, of the particles entrained into a water jet. The present invention is a device for a multi-stage approach for specialized cutting head designs that have the ability to allow higher velocities and energy of the particles so that the cutting head can be designed to produce more effective cutting energy. In accordance with the present invention, subject materials may be cut more effectively by a high-pressure waterjet mixed with abrasive particles in a multi-stage approach.

Adverting now to the drawings, FIG. 1 is a perspective view of the present invention showning a solid component multi-stage cutting head 10, which, in a preferred embodiment, comprises solid member 30 which is the outer shell of the multistage cutting head and has at least a first and second mixing stage; wherein the first mixing stage has a first mixing chamber 24 arranged to accept a first flow of accelerated abrasive particles from first abrasive feed tube 16 (also referred to as an abrasive inlet) and a pressurized liquid flow from orifice 20 wherein the first stage produces a pressurized slurry-like flow. The mixing chamber associated with the first feed tube is arranged to introduce the slurry-like flow to a second mixing stage that has second mixing chamber 24 arranged to accept and mix a second flow of accelerated abrasive particles from second abrasive feed tube 18 with the pressurized slurry-like flow from the first mixing stage and focus that combination through nozzle 12 for the purpose of cutting. The type of materials used to make solid member 30 may vary depending on the abrasive used and the desired output. Orifice 20 may be polished to achieve higher surface finished quality if the manufacturing process, such as injection molding/sintering, does not yield suitable water jet quality.

First abrasive feed tube 16 is positioned so that the pressurized liquid flow reaches it before the second abrasive feed tube 18 which is closest to the exiting jet from orifice 20. In a preferred embodiment of the present invention first abrasive feed tube 16 is connected to a separate abrasive supply of smaller and/or different particles than are introduced into the second fluid jet. Smaller abrasive particles fed into the first feed tube are used to add more energy and mass to the jet to allow for greater effective transfer of jet energy to the main abrasive with larger, and/or higher density particles, thus providing the higher energy efficiency of the entire cutting process. Correspondingly, second abrasive feed tube 18 is then separately supplied with larger and/or different types of abrasive particles that have greater mass than the first particles introduced. These secondary, larger particles make up most of the cutting energy because smaller particles do not have as much cutting energy as larger particles on their own, however both can be beneficially added together to help gradually increase the mass between the lighter liquid to the heavier particles, thus providing for a better mixture. The density of water is far less than the desired abrasives, thus making the mixtures of abrasives into the water jet stream difficult. The speed of water is also orders of magnitude higher than the speed of the abrasive particles introduced into the stream. The abrasive does not naturally enter the stream in these difficult cases so a nozzle is used to mix and focus the water jet with the abrasives.

The purpose of this design is to reduce costs through the utilization of injection molding. Various hard materials such as ceramics, nitrides and carbides can be injection molded in order to reduce costs. Suitable hard materials may include, but are not limited to, tungsten carbide, silicon carbide, alumina, or zirconia.

Figure 2:
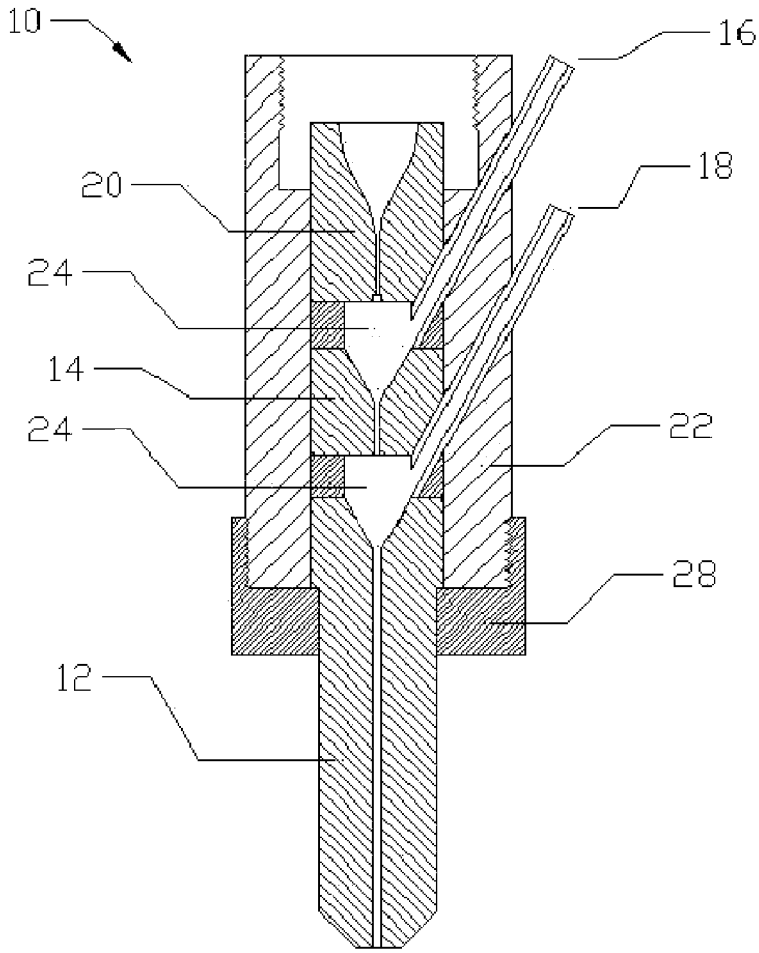
FIG. 2—A perspective view of a modular component multistage water jet cutting head.

Although the solid component multi-stage cutting head 10 of the preferred embodiment, as shown in FIG. 1, is formed in a unitary construction as a single molded unit wherein solid member 30 cutting head must be attached to a sleeve or a suitable body it should be understood, that other constructions may be used without departing from the invention. For example, the modular component multi-stage cutting head 10 having an interchangeable cutting head body 22 as is shown in FIG. 2. The supporting sleeve or body for either embodiment must then be connected to a high pressure system via any suitable method to seal in the pressurized liquid in order that the liquid may only pass through the orifice. High pressure tubing, valves or adaptors can be connected to a multi-stage cutting head 10 by various sealing methods to accomplish this requirement. Nozzle nut 28 of FIG. 2 holds the interchangeable components in place and also may allow for sealing to take place. Also intermediate nozzle 14 is positioned between first abrasive feed tube 16 and a second abrasive feed tube 18. The size bore of intermediate nozzle 14 is generally larger than the inside diameter of orifice 20 and smaller than the inside diameter of final nozzle 12. For example, a 0.015" diameter orifice used with a 0.030" diameter bore final nozzle may allow for an intermediate nozzle size of approximately 0.021" to 0.024". Nozzle 14 helps to focus the smaller particle abrasive jet mixture before mixing with the larger abrasive particles.

Both the single component unit, and the interchangeable modular component unit, multi-stage cutting heads 10, utilize the same principle of successive abrasive feed tubes (16 and 18) in order to supply more than one abrasive type, and/or more than one abrasive size to nozzle 12. Although difference configuration or designs for the instant intervention can be utilized, the significant feature of the invention is the multi-stage cutting head that can mix different abrasive effectively.

Different abrasive types and/or sizes may be fed through the successive abrasive feed tubes (16 and 18) by many methods and in many combinations. Upon exiting the abrasive feed tubes, the abrasives are then mixed with the pressurized liquid jet in the mixing chamber 24 areas. The liquid/abrasive mixtures are then focused together through the use of nozzles (12 and 14). Both styles may also utilize similar orifice geometries 20 of conventional or non-conventional design.

The modular component multi-stage cutting head 10 having an interchangeable cutting head body 22 as shown in FIG. 2 offers greater flexibility of use than the solid member style cutting head. First, a modular component is not limited to materials that can only be used for injection molded units. Second, it offers the ability to interchange orifice 20 or nozzle 12 components for various applications that may require certain abrasive materials. Third, it offers modularity by providing for more orifice and nozzle combinations and ratios without the need for as extensive inventory. Also the interchangeable intermediate nozzle 14 offers even greater flexibility to allow for a wider range of abrasive mixtures.

Figure 3:
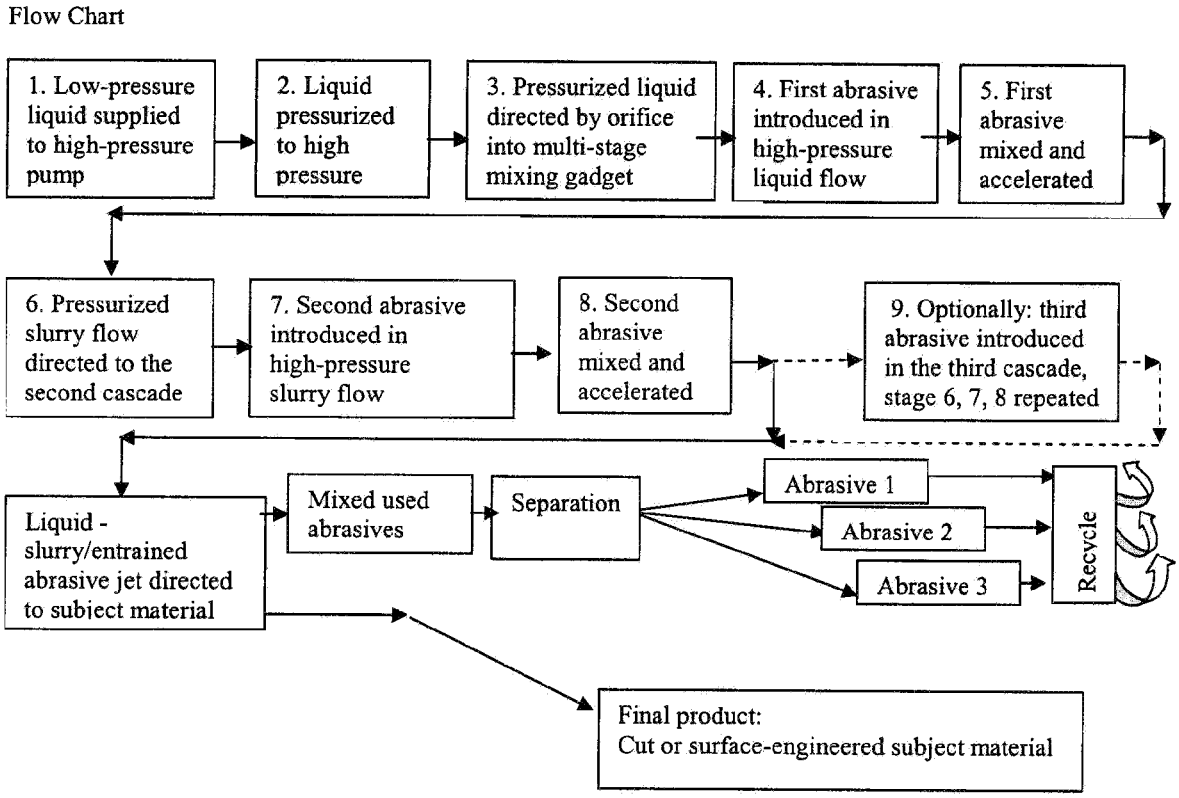
FIG. 3—A Flow Chart depicting possible scenarios of utilizing a multistage cutting head and multiple abrasives in an abrasivejet system.

FIG. 3 is a Flow Chart depicting possible scenarios of utilizing a multistage cutting head and multiple abrasive in an abrasivejet system. Cutting heads a depicted in FIGS. 1 and 2 may be used along with the following steps:

A preferred method for producing an abrasive jet comprises: mixing a first flow of accelerated abrasive particles and a pressurized liquid flow, in a first mixing stage of an abrasive-liquid jet cutting head, to produce a pressurized slurry-like flow that is introduced to a second mixing stage of the abrasive-liquid jet cutting head. Then mixing, in the second mixing stage, the pressurized slurry-like flow with a second flow of accelerated abrasive particles, and focusing the mixture from the second mixing stage to form an abrasive jet. Additional mixing stages can be configured to accept each resulting mixture from each prior stage and accept an additional flow of accelerated abrasive particles to form an abrasive jet.

Also in accordance with the present invention, two or more different abrasive materials may be combined in one abrasive jet. The abrasive materials may differentiate in size of particles, and/or in density (specific gravity) of particles, and/or other physical properties of particles, such ductility vs. brittleness. In a preferred embodiment of the present invention two or more abrasive possessing different physical properties are mixed in the mixing chamber. In particular, the ratio of specific gravity of each sequent introduced abrasive to each prior introduced abrasive is about or greater than 3:2, preferably is about or greater than 2:1; and the ratio of average size of particles of each sequent abrasive to respective preceding abrasive is at least 1.15:1, preferably at least 1.26:1. Another property of the resulting mixture that is regulated is the ratio of concentration of abrasive to liquid. In a preferred embodiment of the instant invention, the first stage produces a slurry-like flow containing first abrasive in the concentration from about 10 to 50 wt-%, most preferably 20 and 33 wt-%, the second stage produces mixed slurry-entrained flow in the combined concentration range of the first and second abrasive from about 25 to 50 wt-%, most preferably 30 to 40 wt-%.

The multistage water jet head is comprised of at least at least two successive stages, each stage is fed with abrasive particles from a single abrasive material or any combination selected from, but not limited to, the following groups of abrasive materials: the first abrasive group comprising glass, obsidian, quartz, aluminum oxide, boron carbide and silicon carbide; the second abrasive group comprising: garnet, olivine, chromite, ilmenite, rutile, pyrite, zircon, hematite, magnetite; the third abrasive group comprising: cassiterite, hard steel, chromium-nickel—based alloys; the fourth abrasive group comprising: hard melting heavy metals including but not limited to: tungsten, molybdenum, tantalum and/or respective carbides.

The use of heavier abrasive particles, such as stainless steel material, with higher fracture toughness compared to garnet, allow for lower overall costs through optimization of the entire abrasive jet process that garnet or other conventional abrasives cannot achieve. Through the effective mixture of select abrasive particles with a multi-stage approach, improvements to the abrasive jet cutting process can be achieved allowing for abrasive jet to become a highly productive and efficient technology.

In one typical example, particles of the same material, such as steel or tungsten carbide with average particle size D1 combined with same material with average particle size D2≦2D1, and preferably D2≦3D1, for example, abrasive material with particles size characterized as 80 mesh combined with same abrasive material with particles size characterized as 320 mesh. The smaller particle abrasive material transfer energy from the fluid jet to larger particles while increasing the speed of larger particles, energy effectiveness and productivity of abrasivejet technology. In another embodiment, steel abrasive can be combined with tungsten carbide powder. Normally, tungsten carbide particles alone may not be effectively used as abrasive in a waterjet due to its exceptionally high density (15.6 vs. ~7.8 of steel vs. 1.0 of water density). Combined with steel abrasive, tungsten carbide possessing high density and high hardness provides super-energetic cutting jet. In summary, the introduction of an abrasive particle with a density intermediate the fluid density and second particle density can create greater total abrasivejet energy either by use of similar material compositions of smaller and larger particles mixed together in the same abrasivejet, or by the mixture of different material compositions of lesser and greater specific gravity.

In another typical example, a multistage abrasive-liquid jet cutting head is tuned to the following specifications: at 50,000 PSI waterjet, 2 gallon/min, first natural inexpensive abrasive is magnetite at 200 mesh size, feeding rate 2 pounds/min into an intermediate nozzle with the internal diameter of 0.04", second abrasive is non-magnetic stainless steel grit, hardness 60 Rockwell C-scale, 80 mesh, feeding rate 1 pound/min into a second nozzle with the internal diameter of 0.05", the subject material is steel sheet. After cutting, the used abrasive mixture is separated magnetically, both stainless steel grit and magnetic is dried and returned into the new cutting process. The dimensions provided above are for reference purposes only. It should be understood other combinations of dimensions are also possible.

The ultimate goal of abrasive jet cutting technology is to provide a satisfactory quality surface finish onto the subject material at the lowest possible cost. Thru cutting of the subject material in length of travel is the main aspect of cutting; typically, removing of a wider channel of material is not required or desired. By focusing of the abrasive jet particle energy into a smaller diameter nozzle, less width of cutting is produced but longer lengths of travel are experienced with the same amount of possible fluid energy from the pump. The output pressure and flow rate of the pump is limited at the maximum capability of the pump but the cutting head is the apparatus that efficiently or inefficiently utilizes the same amount of fixed fluid energy to produce abrasive jet cutting energy.

It is will thus be seen that the objects set forth above, among those made apparent from the preceding description, are effectively attained and, since certain changes may be made in the above construction without departing from the spirit and scope of the invention, it is intended that all matter contained in the above description or shown in the accompanying drawings, shall be interpreted as illustrative and not in a limiting sense. It is also to be understood that the following claims are intended to cover all the generic and specific features of the invention herein described, and all statements of the scope of the invention which, as a matter of language, might be said to fall therebetween.

What is claimed is:

1. A multistage abrasive-liquid jet cutting head comprising:

at least a first mixing stage and a second mixing stage;

a first mixing chamber within said first mixing stage arranged to accept a first flow of accelerated abrasive particles from a first abrasive feed tube and a pressurized liquid flow from an orifice and produce a pressurized slurry-like flow that is introduced to said second mixing stage;

a second mixing chamber within said second mixing stage arranged to accept and mix a second flow of accelerated abrasive particles from a second abrasive feed tube with said pressurized slurry-like flow from said first mixing stage;

an exit nozzle in fluid communication with said second mixing chamber that focuses the combination of said second flow of accelerated abrasive particles from said second abrasive feed tube with said pressurized slurry-like flow from said first mixing stage into an abrasive jet.

2. The multistage abrasive-liquid jet cutting head recited in claim 1 wherein each flow of said accelerated abrasive particles possesses different physical properties.

3. The multistage abrasive-liquid jet cutting head recited in claim 2 wherein, wherein said each flow of accelerated abrasive particles introduced in each successive mixing stage possess heavier abrasive particles than the abrasive particles introduced in each preceding mixing stage.

4. The multistage abrasive-liquid jet cutting head recited in claim 3 wherein the distance between the inlet of said lighter abrasive particles and inlet of said heavier abrasive particles is sufficient to accelerate said lighter particles up to at least 33% of said liquid flow velocity, prior to inlet of the heavier particles.

5. The multistage abrasive-liquid jet cutting head recited in claim 1 wherein said at least a first mixing stage and a second mixing stage is three mixing stages, wherein a third mixing stage is operatively arranged to receive the mixture from said second mixing stage to mix with a third flow of accelerated abrasive to form an abrasive jet.

6. The multistage water jet cutting head recited in claim 1 in which said pressurized liquid flow is directed by an orifice through a single mixing stage comprising two or more mixing chambers, each said mixing chambers contains at least one abrasive inlet.

7. The multistage abrasive-liquid jet cutting head recited in claim 6 wherein the internal diameter of said mixing chamber is larger than the preceding mixing chamber.

8. The multistage abrasive-liquid jet cutting head recited in claim 7, wherein said liquid flow directed through cutting head comprising two or more successive nozzles and at least one abrasive inlet prior to each successive nozzle.

9. The multistage abrasive-liquid jet cutting head recited in claim wherein 7, wherein the internal diameter of each consecutive nozzle is greater than the internal diameter of the preceding nozzle.

10. A method for producing an abrasive jet comprising:

mixing a first flow of accelerated abrasive particles and a pressurized liquid flow, in a first mixing stage of an abrasive-liquid jet cutting head, to produce a pressurized slurry-like flow that is introduced to a second mixing stage of said abrasive-liquid jet cutting head; mixing said pressurized slurry-like flow with a second flow of accelerated abrasive particles in said second mixing stage, and focusing the mixture in said second mixing stage to form said abrasive jet.

11. The method of claim 10 wherein each mixing stage is fed with a flow of accelerated abrasive particles of at least one abrasive material selected from the group consisting of glass, obsidian, quartz, aluminum oxide, boron carbide and silicon carbide.

12. The method of claim 10 wherein each mixing stage is fed with a flow of accelerated abrasive particles of at least one abrasive material selected from the group consisting of olivine, chromite, ilmenite, rutile, pyrite, zircon, hematite, and magnetite.

13. The method of claim 10 wherein each mixing stage is fed with a flow of accelerated abrasive particles of at least one abrasive material selected from the group consisting of cassiterite, hard steel, chromium-nickel—based alloys.

14. The method of claim 10 wherein each mixing stage is fed flow of accelerated abrasive particles of at least one abrasive material selected from the group of hard melting heavy metals consisting of tungsten, molybdenum, tantalum and/or respective carbides.

15. The method of claim 10 wherein the ratio of specific gravity of each sequent introduced abrasive to each prior introduced abrasive is at least 3:2.

16. The method of claim 10 wherein each mixing stage is fed with two or more abrasives possessing different sizes of particles, wherein the ratio of average size of particles of each sequent abrasive to respective preceding abrasive is at least 1.15:1.

17. The method of claim 10 wherein the first mixing stage produces a slurry-like flow containing a first abrasive in the concentration in a range from about 10 to 50 wt-%, and the second mixing stage produces a mixed slurry-like flow in the combined concentration range of the first and second abrasive in a range from about 25 to 50 wt-%.

* * * * *